US006467856B1

(12) United States Patent
Chang et al.

(10) Patent No.: US 6,467,856 B1
(45) Date of Patent: Oct. 22, 2002

(54) MODULAR DISPLAY CASE

(75) Inventors: Dennis L. Chang, East Brunswick, NJ (US); Larry R. Enochs, Columbia, PA (US); Mark R. Hernick, Chadds Ford, PA (US); Christopher T. Rich, Lancaster, PA (US)

(73) Assignee: Oneida, Ltd., Oneida, NY (US)

( * ) Notice: Subject to any disclaimer, the term of this patent is extended or adjusted under 35 U.S.C. 154(b) by 0 days.

(21) Appl. No.: 09/802,396

(22) Filed: Mar. 9, 2001

(51) Int. Cl.[7] ..... A47B 87/00
(52) U.S. Cl. ..... 312/108; 211/134; 312/128
(58) Field of Search ..... 312/119, 122, 312/124, 128, 129, 140.2, 198, 265.1, 265.2, 265.3, 257.1, 117, 270.2; 211/134

(56) References Cited

U.S. PATENT DOCUMENTS 3,085,694 A * 4/1963 Jones ..... 211/134 X
5,083,844 A * 1/1992 Gruenberg et al. .. 312/140.2 X
D406,707 S * 3/1999 Battaglia ..... D6/473
D419,338 S * 1/2000 Battaglia ..... D6/473

* cited by examiner

*Primary Examiner*—John G. Weiss
*Assistant Examiner*—Michael J. Fisher
(74) *Attorney, Agent, or Firm*—Wall Marjama & Bilinski LLP

(57) ABSTRACT

A modular display unit that includes a center section having a vertically disposed frame for supporting a series of shelves and a display counter on either side thereof and having cabinets secured to the frame at either end of the end section which also contains a series of shelves and a display counter. The cabinets are secured to the frame by universal fasteners so that the end cabinets can be removed from the frame and mounted in a back-to-back configuration using the universal fasteners. A pair of end walls are also provided for closing both ends of the center section when the cabinets are removed, again employing the universal fasteners.

13 Claims, 6 Drawing Sheets

MODULAR DISPLAY CASE

FIELD OF THE INVENTION

This invention relates generally to a display unit for cutlery or flatware, and specifically to a modular display unit that can be easily rearranged to provide any one of three different size display units.

BACKGROUND OF THE INVENTION

Many manufacturers of goods, such as flatware or cutlery items, provide their distributors and retailers with distinctive display units for best showing their wares. Although these units are effective sales tools, the units typically are made in one size only. Most stores or shops, however, have varying amounts of floor space available for display units of this type. As a result, the shop owner cannot take advantage of the seller's offer to place a display unit in his or her store.

By the same token, many display units of this nature display the goods so that they can be viewed from one side only with the remaining sides of the case generally being closed. Accordingly, the display unit wastes a good deal of potentially usable display space.

SUMMARY OF THE INVENTION

It is therefore an object of the present invention to improve display units, and, in particular, display units for exhibiting flatware to the consuming public.

It is a further object of the present invention to provide a modular display unit that can be arranged in different configurations without disturbing the general appearance of the unit.

Yet another object of the present invention is to provide a modular display unit that can be arranged in different size configurations so that the unit can be better utilized within an available floor space.

Another object of the present invention is to provide a modular display unit that can be easily and conveniently arranged into a number of different size configurations, each of which will exhibit the display goods from more than one side.

These and other objects of the present invention are attained by a modular display unit that includes a vertically disposed frame having horizontally disposed arms extending outwardly to either side of the frame upon which display shelves are mounted. A pair of identical cabinets also having shelves are removably mounted at each end of the frame to create a first embodiment of the unit. The cabinets further include back panels that are removably attached to the frame by universal fasteners The cabinets can be removed from the frame and secured in a back-to-back configuration using the universal fasteners to create a second embodiment of the unit. A pair of end walls are removably securable to both ends of the frame, again using the universal fastener to create a third embodiment of the unit. Lastly, one end cabinet can be replaced by one end wall to create a fourth embodiment of the unit.

BRIEF DESCRIPTION OF THE DRAWING

For a better understanding of these and other objects of the invention, reference will be made to the following detailed description of the invention which is to be read in connection with the accompanying drawing, wherein.

DETAILED DESCRIPTION OF THE INVENTION

Figure 1:
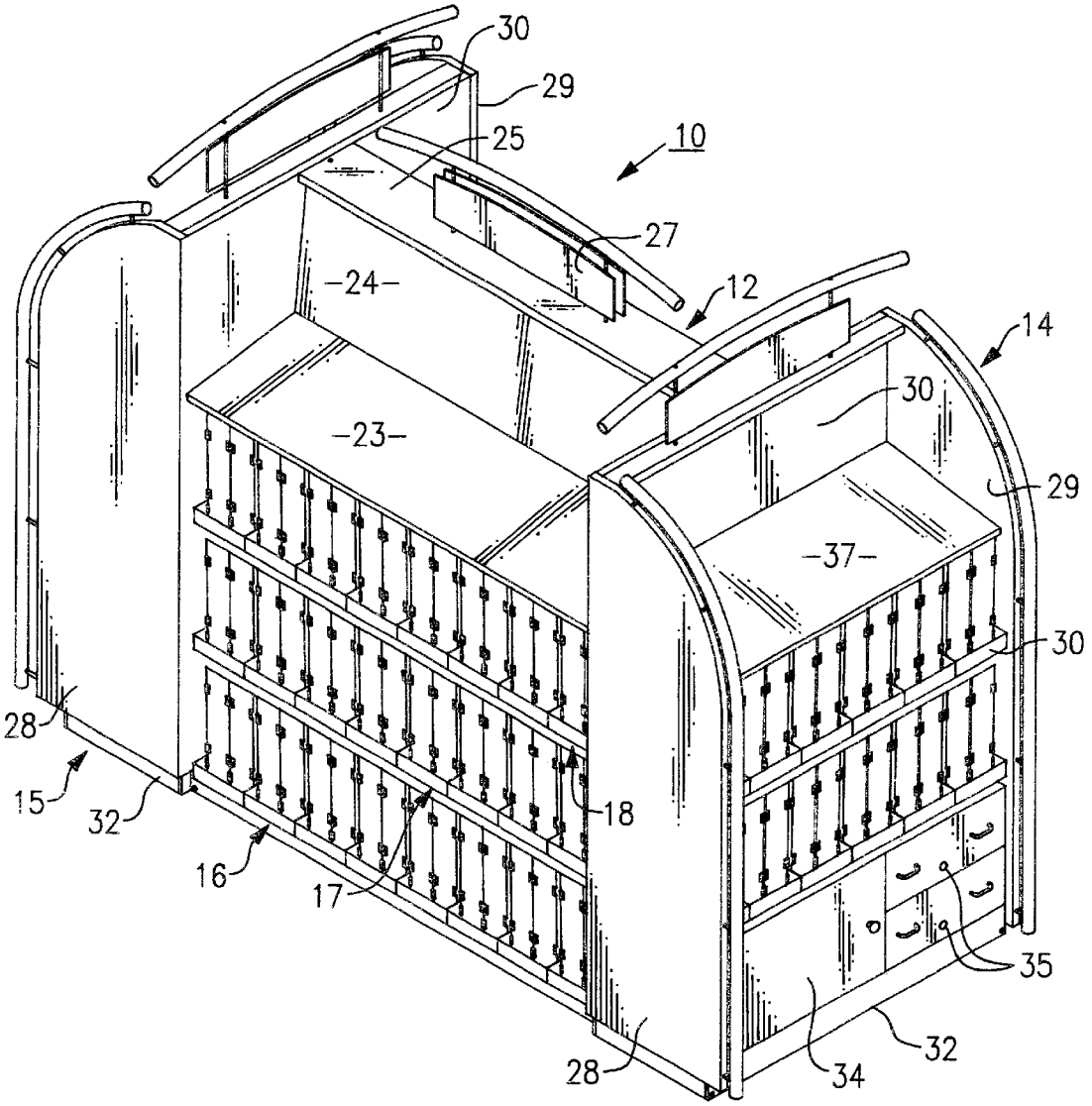
FIG. 1 is a perspective view of a modular display unit having two end cabinets attached to the center section of the unit.

Turning initially to FIG. 1, there is illustrated a modular display unit, generally referenced 10 that embodies the teachings of the present invention. The invention will be described herein with specific reference to a display unit for exhibiting flatware, however, it should be clear that the display unit can be used to exhibit any number of goods and products without departing from the teachings of the present invention. The modular unit illustrated in FIG. 1 includes a center section 12 and a pair of end cabinets 14 and 15 that are removably secured to either end of the center section in perpendicular alignment with the center section. The center section of the unit has three horizontally disposed and spaced apart storage shelves 16–18 extending outwardly to either side of the unit, however, the number of shelves may be changed without departing from the teachings of the present invention.

Figure 6:
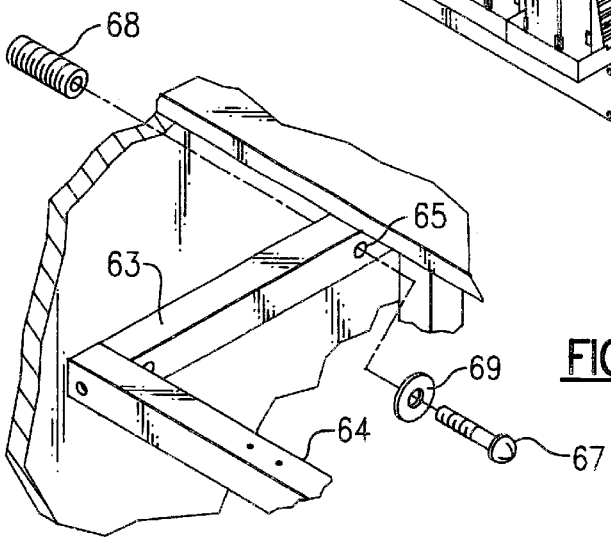
FIG. 6 is a partial view in perspective illustrating one of the universal fasteners used to mount either the end panels or the end cabinets to the main support frame of the center section, or the tab end cabinets in a back-to-back relationship.

As will be described in greater detail below, with reference to FIG. 6, the storage shelves are arranged to hold stacks of boxes 20 containing flatware of different designs so that customers may easily remove the outer box from the stack. Each stack is equipped with a spring driven mechanism for advancing the stack automatically to the front of the shelf when a box is removed from the stack.

A display counter 23 is mounted over the top shelf on either side of the center section upon which the flatware contained in the boxes can be displayed unpackaged so that a customer may better view the flatware products stored in the stack. Although the flatware may be stored in the unit displayed on the counters, ancillary products offered by the seller may also be effectively exhibited. Each counter is furnished with a backboard 24 and the two back boards are, in turn, connected by a top panel 25. A sign board 27 is mounted on the top panel which may contain the seller's name and/or logo imprinted on either side or any other suitable advertising material relating to the goods.

Each end cabinet 14 and 15 are of the same size and shape and, in assembly, are mounted coextensively with the central axis of the center section at either end of the center section. Each cabinet includes a pair of opposed end walls 28 and 29 that are joined to a back panel 30. The end walls and the back panel, in turn, are secured to a base 32. Like the center section of the unit, the end cabinets each have a series of horizontally aligned spaced apart storage shelves 33 for holding stacks of boxes 20 in the same manner as explained above in association with the center sections. One or more of the shelves may be equipped with supply compartments 34 having hinged doors or drawers 35 that can be used to store inventory or the like and which can be locked for security reasons. A display counter 37 is mounted over the top shelf of each end cabinet again for exhibiting unpackaged goods. Rails 38—38 are mounted along the leading edge of the opposed end walls of each cabinet for decorative purposes and to protect the cabinets from harm, which is generally inflicted by various types of vehicles moving through the aisles of the store or shop. Sign panels 39, as described above, are also mounted upon the back panels of the cabinets so that they can be easily read by customers facing either of the cabinets.

Figure 2:
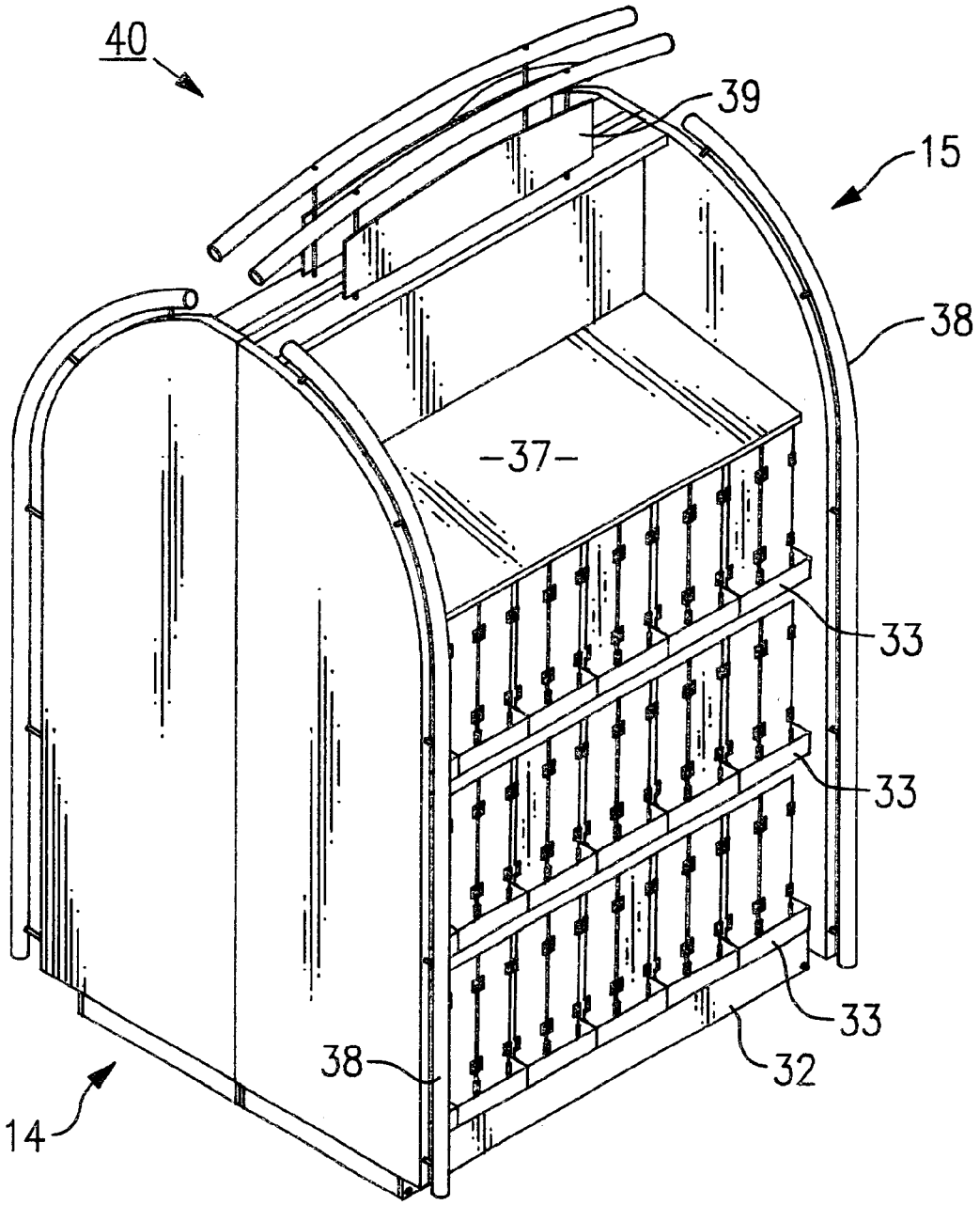
FIG. 2 is a perspective view illustrating the two end cabinets secured in a back-to-back configuration to establish a second embodiment of the unit.

As noted above, the two end cabinets 14 and 15 can be removed from the center section of unit 10. As illustrated in FIG. 2, each cabinet is a mirror image of the other and the two cabinets can be placed in a back-to-back configuration as shown to create a smaller display unit 40 from the two cabinets. As will be explained in greater detail below, the end cabinets are secured to the center section of unit 10 by universal fasteners. The fasteners, in turn, can also be used to join the end cabinets together in the back-to-back assembly to provide a secure display unit.

Figure 3:
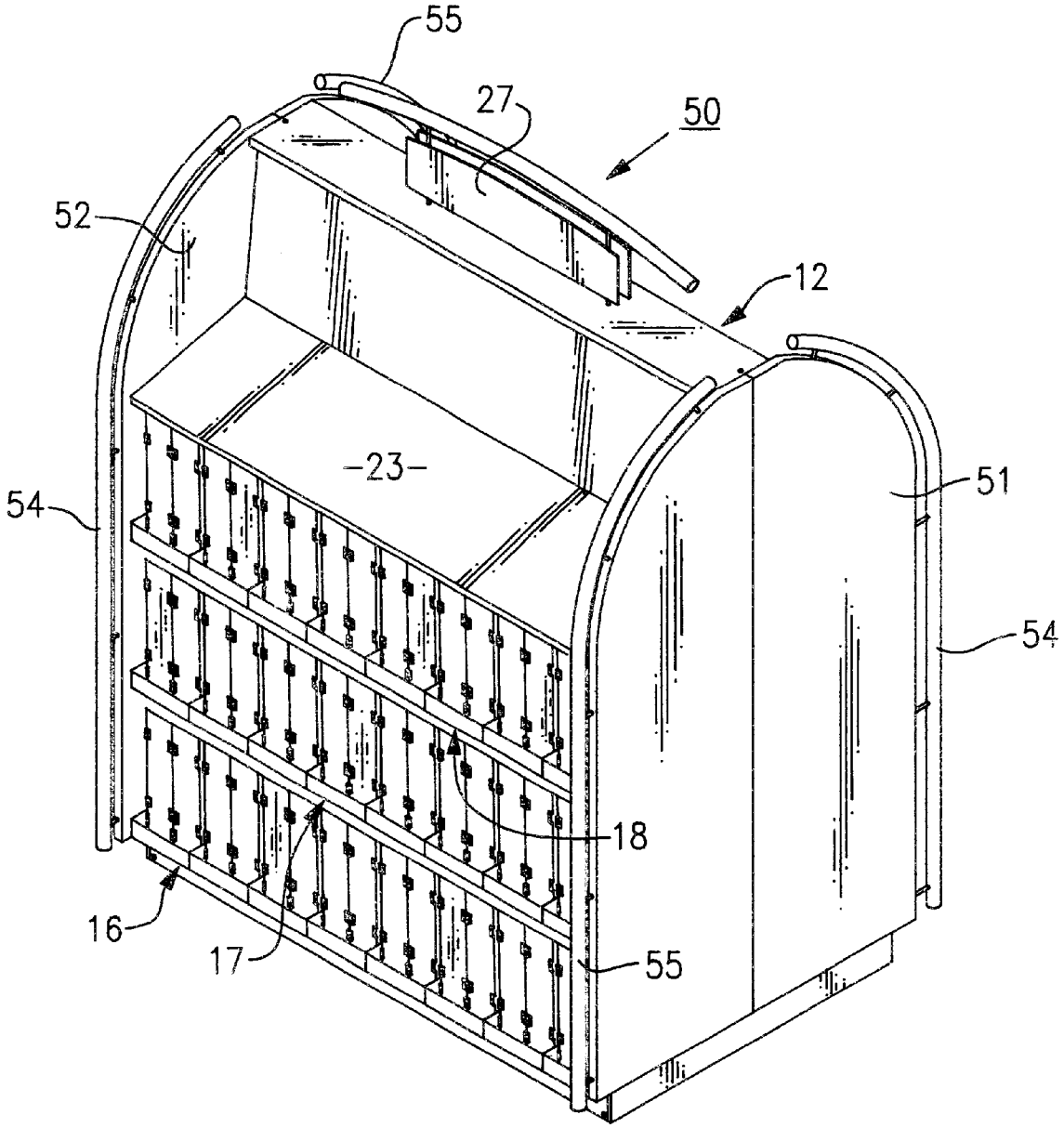
FIG. 3 is a perspective view illustrating the center section of the modular unit with the end cabinets being removed and replaced by end panels to establish a third embodiment of the unit.

With reference to FIG. 3, there is illustrated a further display unit 50, the size of which is about midway between that of units 10 and 40. This mid-sized-unit includes the center section 12 which was described in detail above and a pair of end walls 51 and 52. The end walls are of the same size and shape, and again are attached to opposite ends of the center section 12 using universal fasteners. The end walls are centered upon the central axis of the center section and serve to close ends of this section. Rails 54 and 55 are placed along the outer edges of each end panel, again for decorative purposes and to protect the unit from harm.

Figure 4:
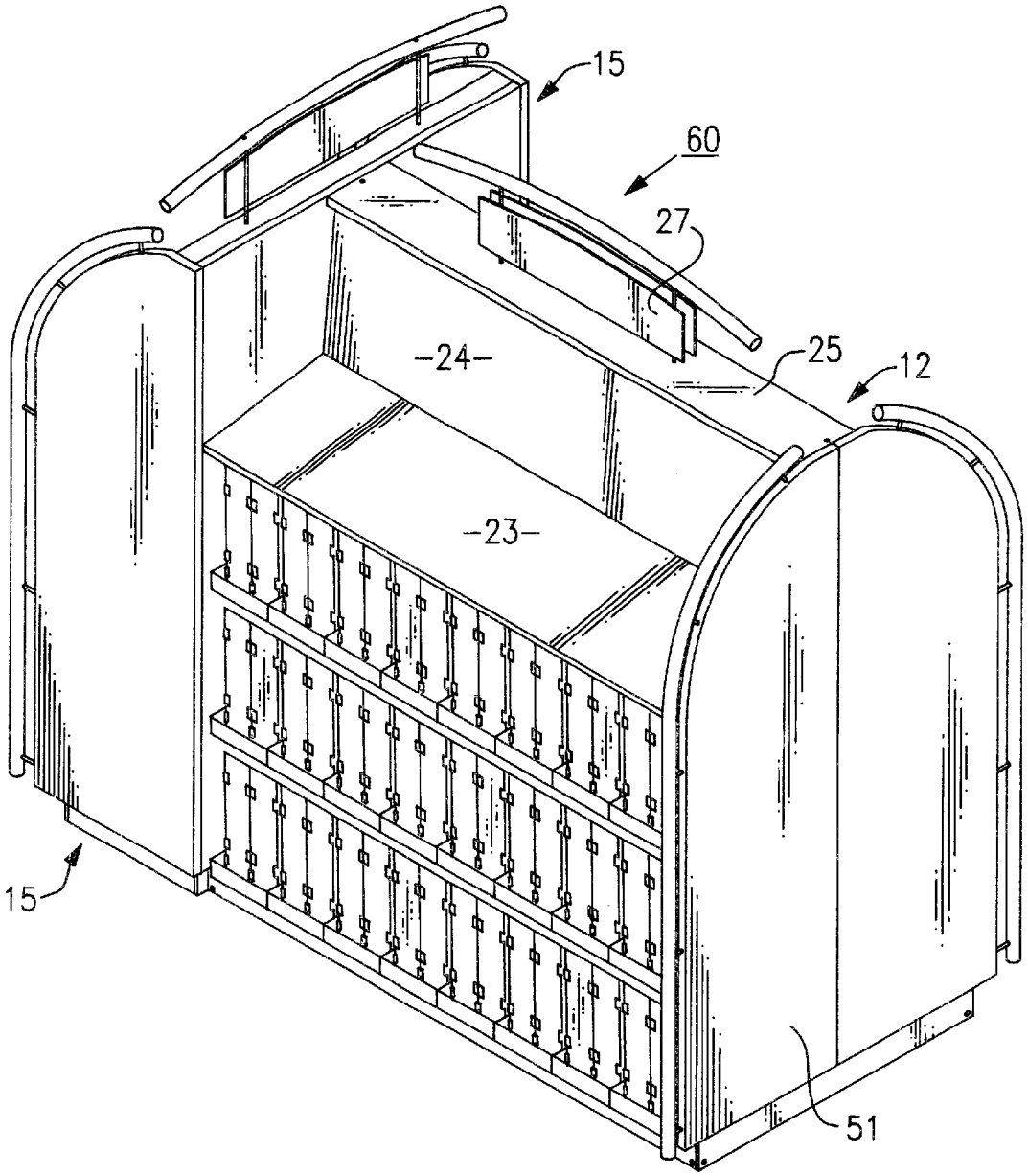
FIG. 4 is a perspective view illustrating the center section of the modular unit with one end cabinet being replaced by an end wall to establish a fourth embodiment of the invention.

As illustrated in FIG. 4, there is shown a further embodiment of the invention generally referenced 60. In this embodiment of the invention, one of the end cabinets has been removed from the frame and replaced with an end wall 51.

Figure 5:
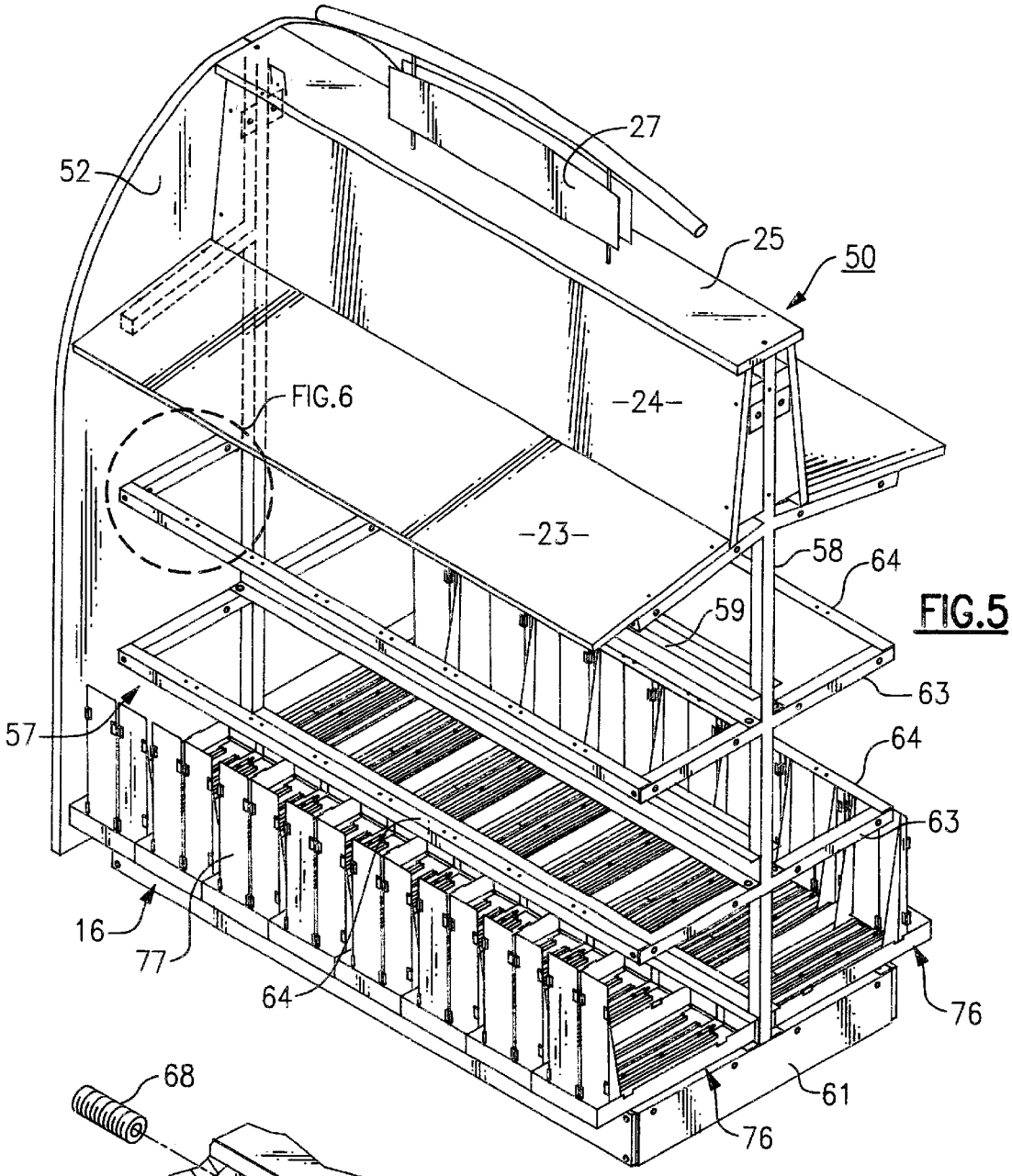
FIG. 5 is a perspective view showing the unit illustrated in FIG. 3 with parts broken away to better illustrate the main vertical support frame of the center section and the horizontal arms for supporting the center section shelves.

The display unit 50 is further illustrated in FIG. 5 with portions broken away to show the internal construction of the central section 12. The central section is equipped with a vertical frame 57 having conjoined vertical members 58 and horizontal members 59 to create a high strength back bone for the section. The frame 57 is securely anchored in the base 61 of the unit. Generally, horizontally disposed arms 63 extend outwardly from the frame to both sides thereof and the distal ends of the arms are connected by cross members 64 to provide supporting structure for the shelves and the display counters. As illustrated in FIG. 6, the arms at opposite ends of the frame are provided with holes 65 through which threaded fasteners such as bolt 67 can pass. The end panels 51 and 52, as well as the back panels of the end cabinets are equipped with threaded inserts 68 for mating with the bolts, thereby allowing the end panels of the cabinets to be secured to the frame. The inserts contained in the end panels extend only partially through the panels so that a smooth continuous outer surface is presented to a customer viewing unit 40. In the case of the cabinets, the threaded inserts extend through both of the back panels. The inserts are axially aligned when the cabinets are placed in a back-to-back relationship as shown in FIG. 2. In this case, the securing bolts are threaded completely through the inset of one cabinet and into the aligned inserts of the other cabinet to pull the cabinets tightly together in assembly.

One or more washers 69 can be placed upon the shank of the bolts to permit the effective length of the bolts to be adjusted in assembly. Accordingly, the threaded fasteners can be universally utilized in each of the display unit configurations. Although a bolt and threaded insert combination is shown in the description of the invention, any other suitable fastening device that lends itself for universal use in each display unit configuration can be used in the practice of the present invention.

Figure 7:
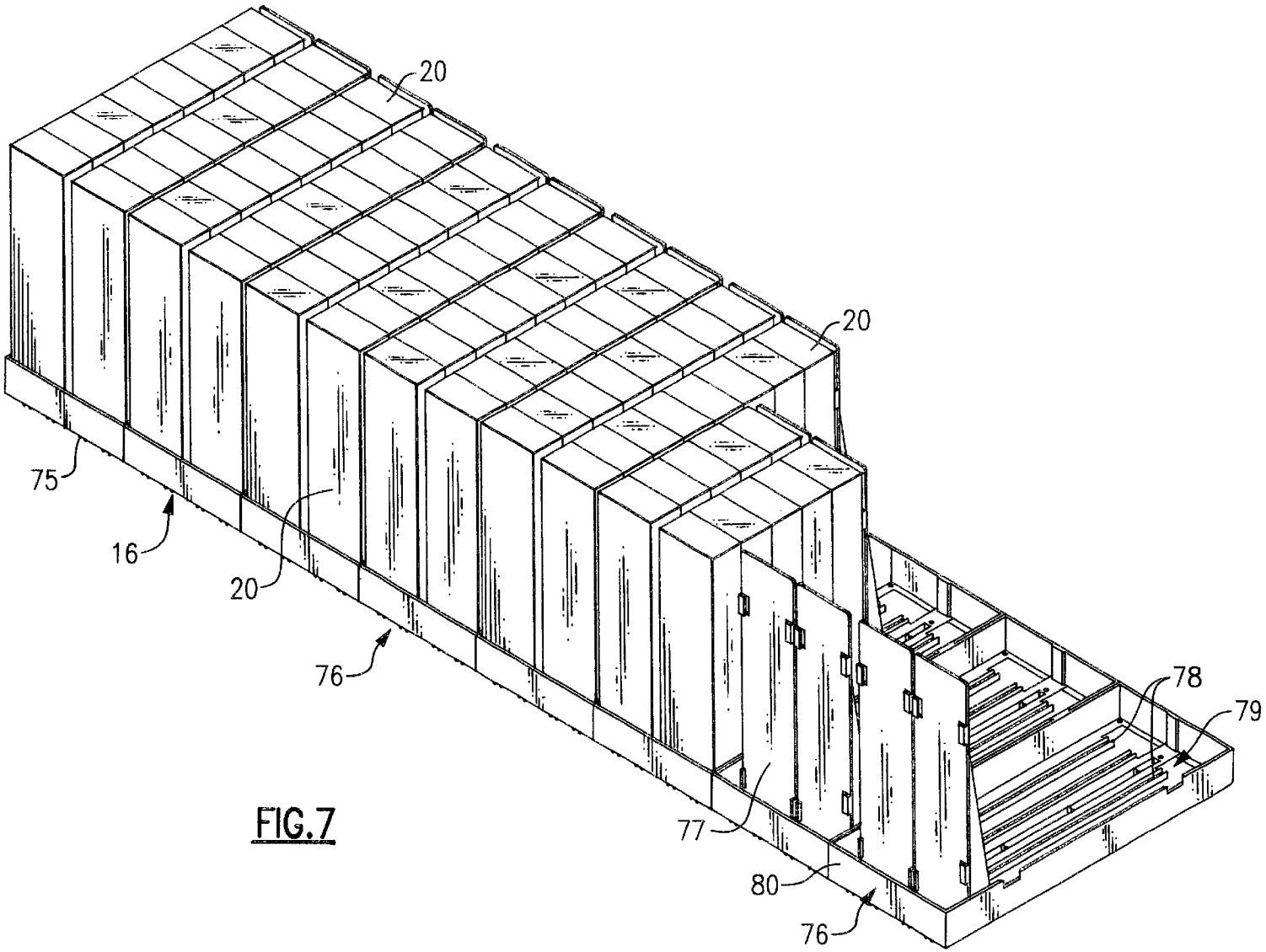
FIG. 7 is an enlarged perspective view illustrating one of the display shelves employed in the center section and in the end cabinets of the modular unit.

FIG. 7 illustrates a portion of a typical storage shelf utilized in the center section and each of the end cabinets of the present invention. Each shelf includes a bottom platform 75 that is attachable to the arms and cross members of the frame. The platform contains a series of adjacent open top trays 76. An elongated vertically disposed wall 77 is slidably contained within parallel slots 78 formed in the base of each tray and which extend longitudinally along the length of the base from the back wall 79 to the front wall 80 of the tray. Coil springs are mounted at the front of each tray that engage the slidably contained wall 77 and urge the wall toward a home position against the front wall of the tray. To load each tray, the boxes 20 are inserted between the front wall 78 of the tray and the slidable wall 77. As the number of boxes increase, wall 77 is moved back toward the rear of the tray and the tension exerted by the unwinding coil spring increases to hold the stack in alignment. As should now be evident, as the front box in the stack is removed, the spring loaded wall 77 urges the stack forward to place the next box in the stack against the front wall of the tray. The first three trays in the shelf shown in FIG. 7 are empty while the next two trays are partially filled and the remaining trays are fully filled with boxes.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A modular display unit that includes:

a self standing center section containing a vertically disposed frame extending between two opposed ends of the central section;

a pair of open faced self standing cabinets having identical back panels, and universal fastening means for removably securing the back panels of said self standing cabinets to opposite ends of said frame in perpendicular alignment with said frame wherein both of said cabinets can be removed from said center section and joined together in a back-to-back relationship with said universal fastening means or one of said cabinets can be removed from the center section and employed as a stand alone unit.

2. The modular display unit of claim 1 that further includes a pair of end walls that are interchangeably mountable at opposite ends of said frame by said universal fastening means to close the ends of said center section when one or both of said end cabinets are removed from said frame.

3. The modular display unit of claim 2 wherein said universal fasteners include bolts arranged to pass through horizontally disposed arms mounted at either end of said frame and threaded inserts mounted in the back panels and the end walls for threadably receiving said bolts wherein the cabinets and end walls can be interchangeably secured to the frame or the end cabinets can be secured in a back-to-back relationship to establish different unit configurations.

4. The modular display unit of claim 1 wherein said frame further includes vertically spaced support means extending outwardly to either side thereof and a series of horizontally disposed shelves mounted upon said support means.

5. The modular display unit of claim 4 that further includes a horizontally disposed display counter mounted upon said support means over said shelves.

6. The modular display unit of claim 5 wherein each cabinet contains vertically disposed side walls connected to said back panel and a series of horizontally disposed shelves extending between said side walls.

7. The modular display unit of claim 6 wherein each end cabinet further includes a horizontally disposed display counter mounted over said cabinet shelves that extend between the side walls of the cabinet.

8. The modular display unit of claim 6 wherein each shelf contains a series of side by side open top trays, each tray having opposed side walls, a back wall and a front wall for containing a stack of boxes between the front wall and the back wall of the tray.

9. The modular display unit of claim 6 wherein one of said shelves contains at least one compartment for storing inventory.

10. The modular display unit of claim 6 wherein one of said shelves contain at least one drawer for storing inventory.

11. The modular display unit of claim 1 wherein said vertically disposed frame further includes vertical spaced apart columns mounted within a base and horizontal members for interconnecting the vertical columns.

12. The modular display unit of claim 11 that further includes a display board mounted upon the top of said frame.

13. The modular display unit of claim 12 wherein each of the removable end cabinets further includes a display board mounted upon the back panel thereof.

* * * * *